US008742920B2

(12) United States Patent
Edwards et al.

(10) Patent No.: US 8,742,920 B2
(45) Date of Patent: Jun. 3, 2014

(54) SYSTEM AND METHOD FOR REAL TIME ANTI-SMASH PROTECTION

(75) Inventors: Lewin A. R. W. Edwards, Forest Hills, NY (US); Robert W. Marabella, Glen Cove, NY (US); Dan Tyroler, Great Neck, NY (US)

(73) Assignee: Honeywell International Inc., Morristown, NJ (US)

( * ) Notice: Subject to any disclaimer, the term of this patent is extended or adjusted under 35 U.S.C. 154(b) by 226 days.

(21) Appl. No.: 13/403,274

(22) Filed: Feb. 23, 2012

(65) Prior Publication Data

US 2013/0222131 A1 Aug. 29, 2013

(51) Int. Cl.
*G08B 23/00* (2006.01)
*G08B 13/08* (2006.01)

(52) U.S. Cl.
CPC ..... *G08B 13/08* (2013.01)
USPC ..... 340/527; 340/521; 340/506; 726/22

(58) Field of Classification Search
CPC ..... G08B 13/08
USPC ..... 340/527, 506, 521, 529; 726/22
See application file for complete search history.

(56) References Cited

U.S. PATENT DOCUMENTS

| | | | | |
|---|---|---|---|---|
| 7,656,287 | B2 * | 2/2010 | Albert et al. | 340/521 |
| 2003/0071724 | A1 * | 4/2003 | D'Amico | 340/506 |
| 2008/0079561 | A1 | 4/2008 | Trundle et al. | |
| 2010/0318627 | A1 * | 12/2010 | Edwards et al. | 726/22 |

FOREIGN PATENT DOCUMENTS

| | | | |
|---|---|---|---|
| EP | 2 261 874 | A1 | 12/2010 |
| WO | WO 01/40912 | A2 | 6/2001 |

OTHER PUBLICATIONS

European Search Report for corresponding EP application 13155654.0 dated Jun. 3, 2013.

* cited by examiner

*Primary Examiner* — John A Tweel, Jr.
(74) *Attorney, Agent, or Firm* — Husch Blackwell LLP

(57) ABSTRACT

An apparatus to provide real time anti-smash protection for monitoring systems includes a displaced server which communicates with a plurality of monitoring systems. Methods of operating the server provide assurance that alarm indicating messages are forwarded to a monitoring station for evaluation by an operator even where a local monitoring system has been damaged or compromised.

13 Claims, 4 Drawing Sheets

SYSTEM AND METHOD FOR REAL TIME ANTI-SMASH PROTECTION

FIELD

The application pertains to security monitoring systems. More particularly, the application pertains to such systems which provide information indicating that a local security panel has been compromised.

BACKGROUND

There is a well-known issue with security panels (particularly self-contained systems): if the panel is easily accessible, a burglar could in theory force entry and disable the panel during the entry delay period, before it has time to send an alarm. The normal workaround for this is to hide the panel and use a remote keypad, but this has cost implications.

Known methods that offer solutions for the above mentioned problem rely on the security panel to follow up with a cancellation report message (prior to the expiration of the delay report time). Once this cancellation report is received by an alarm network service provider, the original alarm report is removed and no report is sent to the monitoring service. Such solutions were designed for the POTS era, where delivery of messages from panel to central station was assumed to be slow and infrequent.

Alternately, systems have been configured such that any fault caused within an armed regional monitoring system causes a "pre-alarm" to be sent immediately to the central station, during the entry delay period. If the user disarms the system within a specified time interval, the "pre-alarm" is automatically canceled.

DETAILED DESCRIPTION

Figure 1:
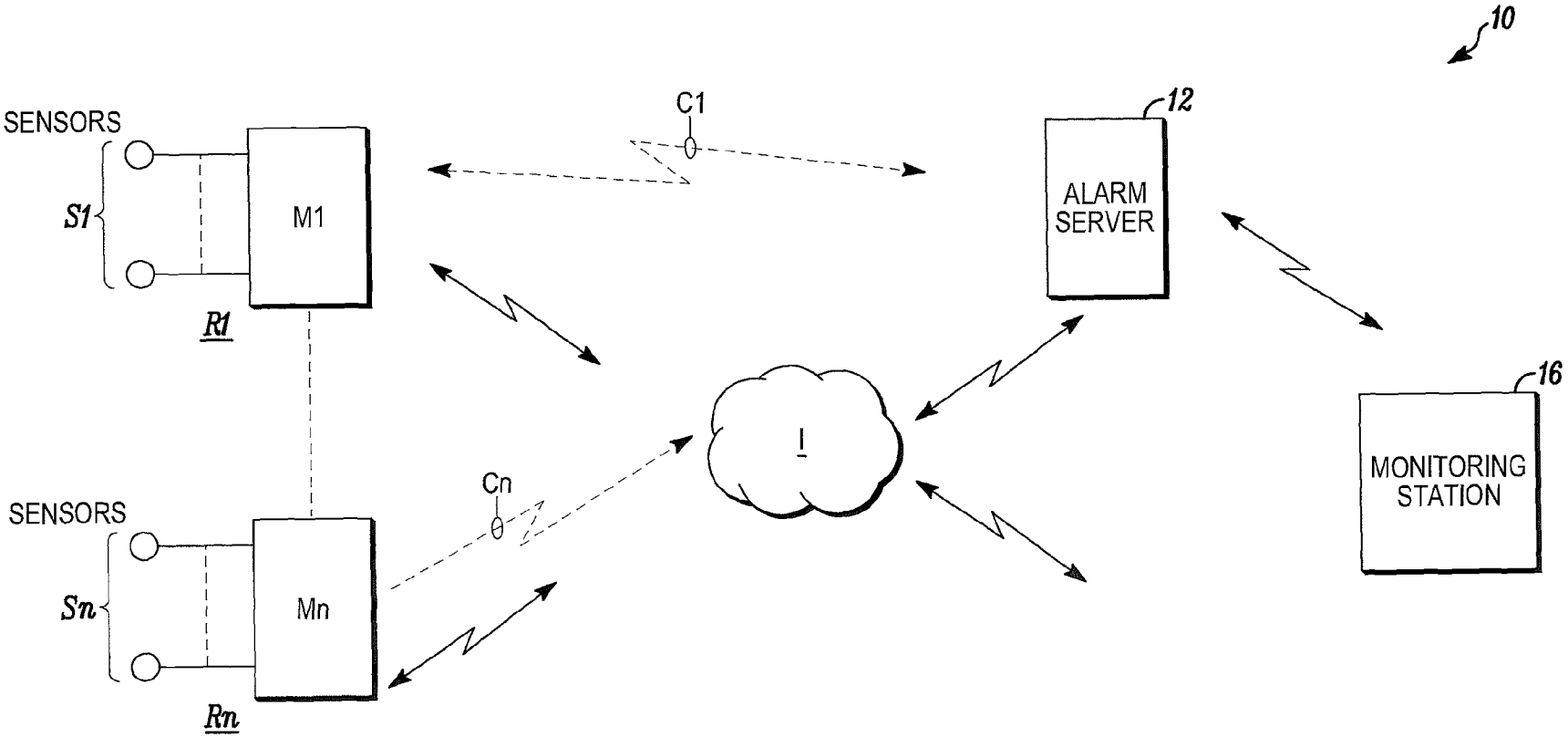
FIG. 1 is an over-all view of an apparatus in accordance herewith.

While disclosed embodiments can take many different forms, specific embodiments hereof are shown in the drawings and will be described herein in detail with the understanding that the present disclosure is to be considered as an exemplification of the principles hereof, as well as the best mode of practicing same, and is not intended to limit the claims hereof to the specific embodiment illustrated.

Systems and methods in accordance herewith not only provide smash protection, they are also advantageous in being able to reduce the cost of servicing groups of security panels configured with broadband connections to local Internet providers. In accordance with an Internet enabled embodiment hereof, instead of all messages being "pushed" from the panel when events occur, an alarm network server "pulls" status information regularly from the panels. In this regard, the entire status of a typical residential monitoring panel can be expressed in a data packet of less than 500 bytes. On a very low-end 128 Kbps DSL line, transferring this much information takes approximately 0.05 seconds; on a standard 10 Mbps cable connection, this time period is about 0.0005 seconds.

The server could pull the panel's state, for instance, once every ten seconds. As a result, the server always has a snapshot of what is happening in the residence, or other region being monitored, which is, at most, ten seconds old. Additionally, related "apps" that perform tasks based on changes in system state will already have needed real-time information about the panel's state. The abovementioned process thus provides other benefits besides smash protection.

Alternately, the panel can periodically "push" relevant status, or other information to the server. Those of skill will understand that this embodiment can be used in combination with the server pulling the panel's status, as discussed above.

In accordance with the above, the server can proceed as follows. The panel can be regularly queried until an alarm condition occurs. If the alarm is NOT of a type (burglary, fire, panic) that might be the precursor of a smash event, then it can be processed immediately. For example, a moisture alarm from a leak sensor has nothing to do with potential burglary or home invasion, and does not need special handling. Such alarms would just be reported immediately.

If the alarm is of a type that might reflect or indicate a possible smash event, it can be queued for dispatch to the central station, but not sent immediately. Instead, a timer corresponding to the remaining entry delay of the alarm panel can be started. This information is communicated from the panel during the status pulling event. Regular pulling, collecting and queuing any further alarm messages from the panel can be on-going.

In connection with the above, all queued alarms can be immediately sent to the central station if either of the following occurs: the panel fails to respond to a status pull for example, or the entry delay timer expires. If the panel status changes to "disarmed" while the timer is still running, the timer can be canceled and the queued alarm message deleted.

Additionally, if the panel fails to respond to pulls at any time, this may mean that the panel was smashed before it could deliver a fault message. The server can attempt to contact it by an alternate route (if available) and simultaneously begin an alarm timer countdown process as described above.

In one aspect, where the security panel is maintained by a cable company, the "server" mentioned here need not be part of the central station. It can be a separate element employed solely to determine if smash events are taking place. This server only relays alarm messages once it has carried out the above described process.

This function, in a cable context, can be performed several ways; either by having an intermediary server, part of an alarm network, or by using deep packet inspection to identify and route the alarm traffic. In the latter case, the anti-smash function becomes part of the carrier's network infrastructure. In this case, traffic to the central station is reduced. In the case where the panel has multiple interfaces, for example a cheap but less-reliable IP connection and an expensive but fully-reliable GSM connection, the cheap, fast interface can be used for all this traffic without needing to fallback to the GSM connection.

In an alternate embodiment, an alarm reporting apparatus and method will result in delivering to the monitoring service an original alarm event that was created, or triggered, initially by the intruder. The notification occurs even though panel did not report an alarm, as expected under normal conditions at the expiration of the reporting delay time, because security system was damaged by intruder during the delay reporting period.

Advantageously, in accordance herewith, an initial, or, premature alarm report message will be sent immediately (without waiting for the alarm report delay to expire) to an intermediate service provider. This service provider, for example an alarm network service, will temporarily delay delivery of the original alarm message for the duration of time equivalent to the alarm report delay period.

At the end of the alarm report delay, the server, or, intermediate service provider will send a unique message back to the security panel asking "is everything ok"? If no response is received from the security panel, then the intermediate service provider forwards the original alarm report (that it had previously received) to the monitoring service, or, central station. If the security panel responds back by "I am ok and was disarmed by a valid user" message, the intermediate service provider will delete the original alarm report, which it was holding, and no message will be sent to the monitoring service.

Those of skill in the art with understand that the type of the message that gets sent originally to the intermediate service provider, the delayed alarm type, may vary and only needs to be distinguished from regular alarm reports that get normally forwarded immediately to the monitoring service. It will also be understood that various types of communications channels can be provided to deliver the reports. Examples include, without limitation, gsm radio, internet, or phone lines.

In accordance herewith, it is the server, or, intermediate service provider, for example, an internet based alarm network that is responsible to check with, or query, the security panel prior to forwarding the alarm message to the monitoring service. That service provider also confirms that the security panel is functional and was legitimately disarmed, prior to expiration of the delay report. If there is no response from the security panel, only then does the service provider, the alarm network for example, forward the original alarm to the monitoring service.

FIG. 1 illustrates an embodiment of an apparatus 10 in accordance herewith. The apparatus 10 includes a plurality of regional monitoring systems M1 . . . Mn each of which monitors a respective region such as R1 . . . Rn. The monitoring systems Mi can include, without limitation pluralities of security or ambient condition or both, types of sensors S1 . . . Sn as would be understood by those of skill in the art. Those of skill will understand that neither the exact configuration, nor location nor types of sensors are limitations hereof.

The systems Mi are in bi-directional communication with an alarm network server 12 via wired or wireless media. In one aspect, communications can be implemented via public or private, computer networks, for example the Internet I. Alternately, other forms of direct wired, or wireless communications C1 . . . Cn, indicated in dashed lines, can be used to communicate between the systems M1 . . . Mn and server 12.

Server 12 can also communicate directly or via one or more networks with a monitoring station 16 where an evaluation of various reported alarm conditions can be made by human operators. Server 12 can implement either of the above described communications processes to provide the described secure alarm reporting even in the presence of a damaged or disabled monitoring system.

Figure 2A:
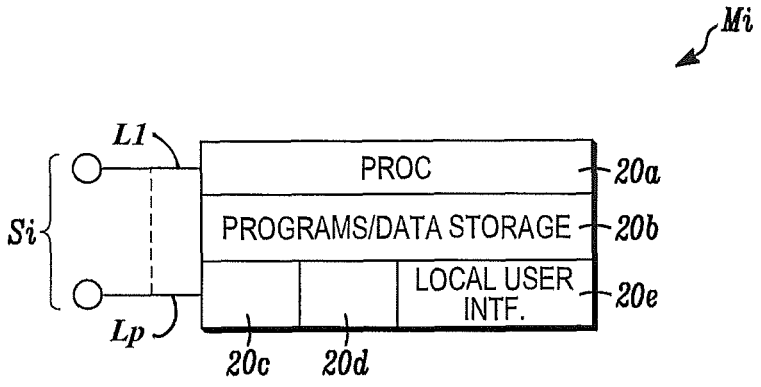
FIG. 2A illustrates details of a system usable with the apparatus of FIG. 1.

FIG. 2A illustrates additional details of a monitoring system Mi. System Mi can include one or more programmable processors 20*a* and associated storage for executable programs and/or data 20*b*. Processor 20*a* can be coupled to and receive signals L1 . . . Lp from sensors Si via a sensor interface 20*c*.

Processor 20*a* can also communicate bi-directionally with the server 12 via a communications interface 20*d*. Local communications can be implemented with a user interface 20*e*, for example a display and a keyboard.

Figure 2B:
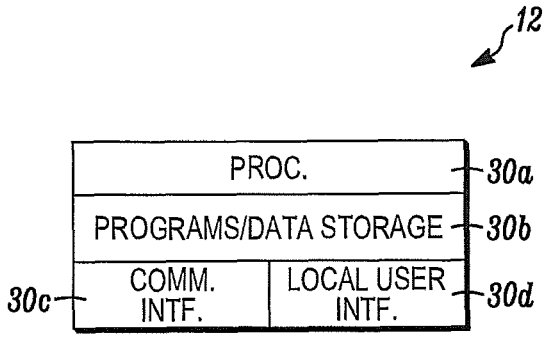
FIG. 2B illustrates details of a server usable with the apparatus of FIG. 1.

FIG. 2B illustrates a block diagram of server 12. Server 12 can include one or more programmable processors 30*a* and associated storage for executable programs and/or data 30*b*. Processor 30*a* can also communicate bi-directionally with the plurality of monitoring systems Mi via a communications interface 30*c*. Local communications can be implemented with a user interface 30*d*, for example a display and a keyboard.

Figure 3A:
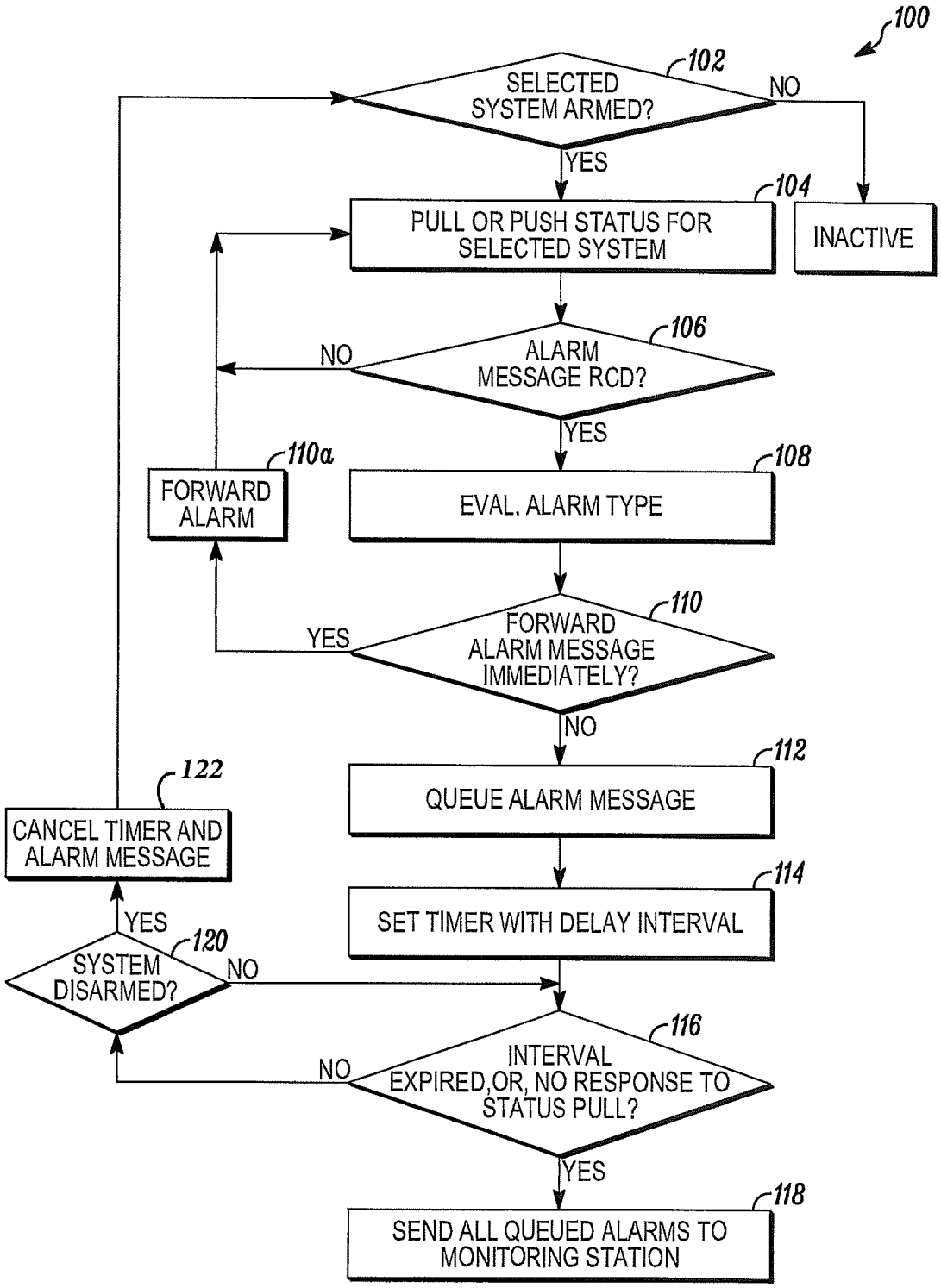
FIG. 3A is a flow diagram of a method in accordance herewith.

FIG. 3A illustrates a flow diagram of a process 100 implementable with the apparatus 10 in providing a secure indicator of an alarm event. If a system is armed, as at 102, a status indicator can be pulled for that system by server 12, as at 104. Alternately, as indicated at 104, the panel can push status, or other, information to the server.

If the status indicator shows that an alarm has been received, as at 106, the type of alarm is evaluated as at 108. If the type of alarm might be a precursor, or indicator, of a possible smash event, the server 12 can put that alarm indicator in a queue, as at 112. A timer can be started as at 114. Otherwise, the alarm can be forwarded immediately, as at 110*a*.

If the timer expires, or there is no response to a subsequent status pull 116, by the respective alarm system Mi, the server can immediately send all queued messages to the monitoring station for evaluation, as at 118. Alternately, if the system status indicates that it has become disabled, as at 120, the timer can be canceled and the queued alarm message can be deleted as at 122.

Figure 3B:
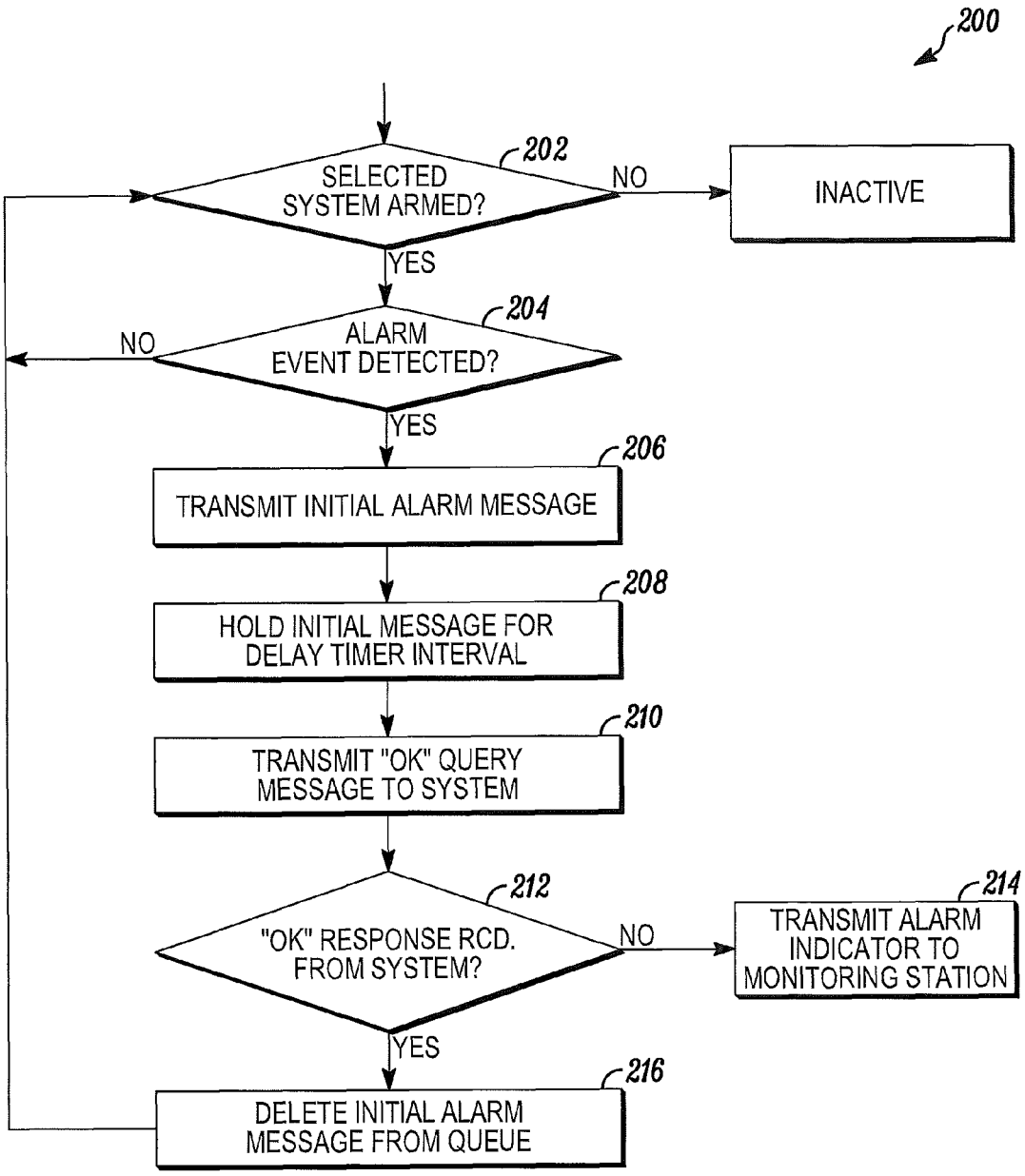
FIG. 3B is a flow diagram of another method in accordance herewith.

FIG. 3B illustrates a flow diagram of alternate processing 200. Where a monitoring system, such as Mi is armed, as at 202, and an alarm event is detected, as at 204 a pre-mature alarm message can be immediately transmitted to the server 12, as at 206. The message can be held at the server for a delay interval, as at 208. If the system is disarmed during the delay interval, the pre-mature message is not sent by the server to the monitoring station.

At the end of the delay interval, an "OK?" inquiry is sent to the respective system, such as Mi, as at 210. If an "OK" response is received from the respective system 212, the pre-mature message is deleted from the queue, as at 216. Alternately in the absence of the "OK" response, the alarm message is sent to the monitoring station, as at 214.

Those of skill will understand in both of the processes 100, and 200, the server 12 determines if an alarm message should be sent to the monitoring station based on feedback, or lack thereof, it has received from the respective system Mi. Hence, in embodiments hereof, alarm indicating messages are forwarded to a monitoring station for evaluation by an operator even where a local monitoring system has been damaged or compromised.

From the foregoing, it will be observed that numerous variations and modifications may be effected without departing from the spirit and scope of the invention. It is to be understood that no limitation with respect to the specific apparatus illustrated herein is intended or should be inferred. It is, of course, intended to cover by the appended claims all such modifications as fall within the scope of the claims.

Further, logic flows depicted in the figures do not require the particular order shown, or sequential order, to achieve desirable results. Other steps may be provided, or steps may be eliminated, from the described flows, and other components may be add to, or removed from the described embodiments.

The invention claimed is:

1. An apparatus, which includes a regional monitoring system, comprising:

a displaced alarm processing server wherein the system and the server communicate, at least in part, by one of a wired, or, a wireless medium, and wherein the monitoring system has armed and disarmed states with an alarm delay time interval activated in response to detecting a selected event and wherein the server includes circuitry to query the system, at least intermittently, in accordance with a predetermined temporal parameter, the selected event corresponding to a detected alarm condition, and a type of alarm is evaluated by the server to determine if an alarm indicator should be immediately sent to a monitoring service location.

2. An apparatus as in claim 1 wherein status information is acquired by at least one of, the server pulls status information from the system periodically and the temporal parameter comprises a pulling period, or, the monitoring system pushes status information intermittently to the server.

3. An apparatus as in claim 1 where the server queries the system at the end of the delay time interval which corresponds to the predetermined temporal parameter.

4. An apparatus as in claim 3 where a timer is activated for a selected duration in response to determining that the alarm indicator should be held and not be immediately sent to the monitoring service location.

5. An apparatus as in claim 4 where any held alarm indicator is sent to the monitoring service location in the event that the timer duration expires or, the system fails to respond to a request for status.

6. An apparatus as in claim 5 where the system includes a plurality of condition sensors and, the selected event comprises selected signals from at least one sensor.

7. An apparatus as in claim 6 wherein an indicium of a signal from a selected intrusion indicating sensor, when received by the system, is transmitted to the server and queued for subsequent transmission to the monitoring service location.

8. An apparatus as in claim 7 where the queued indicium is canceled in response to the system assuming a disarmed status.

9. An apparatus as in claim 3 and responsive to a selected reply message, the server determines that the system has been disarmed.

10. An apparatus as in claim 3 where the server receives and holds for the delay interval, an initial alarm indicating message from the system.

11. An apparatus as in claim 10 where the server transmits a follow-up status request message to the system at the end of the delay interval, and in the absence of a selected response, forwards the alarm indicating message to the monitoring station.

12. A method comprising:

providing a regional monitoring system;

establishing an armed state at the system;

providing a displaced control element and responsive to receiving an alarm indicating message from the system, the control element establishes a delay interval;

responsive to the delay interval expiring while the system is armed, the control element transmits one of a status inquiry to the system, or, an alarm indicating message to a monitoring station; and responsive to a type of alarm, one of transmitting the alarm message immediately, or, queuing the alarm message.

13. A method as in claim 12 where the control element periodically pulls a status indicium from the system, and responsive to receiving the alarm indicating message therein, evaluates the alarm type.

* * * * *